US011927080B2

(12) United States Patent
Khaksar et al.

(10) Patent No.: US 11,927,080 B2
(45) Date of Patent: Mar. 12, 2024

(54) SAND SCREEN SELECTION

(71) Applicants: Abbas Khaksar, Swanbourne (AU); Tarik Abdelfattah, Houston, TX (US)

(72) Inventors: Abbas Khaksar, Swanbourne (AU); Tarik Abdelfattah, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 55 days.

(21) Appl. No.: 17/843,056

(22) Filed: Jun. 17, 2022

(65) Prior Publication Data

US 2023/0129272 A1 Apr. 27, 2023

Related U.S. Application Data

(60) Provisional application No. 63/271,516, filed on Oct. 25, 2021.

(51) Int. Cl.

| | |
|---|---|
| ***E21B 43/10*** | (2006.01) |
| ***E21B 43/08*** | (2006.01) |
| ***E21B 43/34*** | (2006.01) |
| ***E21B 43/38*** | (2006.01) |

(52) U.S. Cl.

CPC ..... *E21B 43/10* (2013.01); *E21B 43/08* (2013.01); *E21B 43/35* (2020.05); *E21B 43/38* (2013.01)

(58) Field of Classification Search

CPC ..... E21B 43/10; E21B 43/38; E21B 43/35; E21B 43/08

See application file for complete search history.

(56) References Cited

U.S. PATENT DOCUMENTS

| | | | | |
|---|---|---|---|---|
| 7,181,380 | B2 * | 2/2007 | Dusterhoft | E21B 43/00 166/250.1 |
| 8,622,128 | B2 | 1/2014 | Hegeman | |
| 2004/0149431 | A1 * | 8/2004 | Wylie | E21B 43/103 175/57 |
| 2006/0000607 | A1 * | 1/2006 | Surjaatmadja | E21B 43/35 166/50 |
| 2008/0196942 | A1 * | 8/2008 | Bingham | G01G 11/003 175/46 |
| 2008/0319675 | A1 * | 12/2008 | Sayers | G01V 1/50 702/11 |
| 2009/0205819 | A1 * | 8/2009 | Dale | E21B 49/00 166/305.1 |

(Continued)

OTHER PUBLICATIONS

"Sand Screen Selector"; Open Hole; Weatherford Brochure 6911.01; Retrieved Online from https://www.weatherford.com/documents/brochure/products-and-services/completions/sand-screen-selector on Jan. 26, 2023; 7 Pages.

(Continued)

*Primary Examiner* — Shane Bomar

(74) *Attorney, Agent, or Firm* — CANTOR COLBURN LLP

(57) ABSTRACT

Examples described herein provide a method that includes performing a geomechanical analysis for a wellbore for each of a plurality of sand screens. The method further includes selecting a sand screen from the plurality of sand screens based at least in part on the geomechanical analysis. The method further includes deploying the selected sand screen in a tubular of the wellbore to filter particulate passing through an opening of the tubular.

20 Claims, 12 Drawing Sheets

(56) References Cited

U.S. PATENT DOCUMENTS

| | | | | |
|---|---|---|---|---|
| 2009/0216508 | A1* | 8/2009 | Dale | E21B 49/00 703/10 |
| 2010/0299111 | A1* | 11/2010 | Dale | E21B 49/00 703/2 |
| 2011/0011595 | A1* | 1/2011 | Huang | E21B 43/00 703/10 |
| 2011/0061860 | A1* | 3/2011 | Dean | G01V 99/005 703/2 |
| 2012/0152538 | A1* | 6/2012 | Todd | E21B 43/04 166/278 |
| 2017/0205388 | A1* | 7/2017 | Thomas | E21B 47/005 |
| 2019/0003273 | A1* | 1/2019 | Bigrigg | E21B 43/08 |
| 2021/0040837 | A1 | 2/2021 | Al-Rabeh | |

OTHER PUBLICATIONS

Andrews et al.; "Sand Screen Selection"; Oilfield Review; Issue 27, No. 2; Sep. 2015; pp. 22-29.

Christiana et al.; "Geomechanical Program for Sand Control Techniques"; International Journal for Research in Emerging Science and Technology; vol. 2, Issue 10; Oct. 2015; pp. 45-53.

International Search Report and Written Opinion Issued in International Application No. PCT/US2022/078406 dated Feb. 2, 2023; 10 Pages.

* cited by examiner

240

245

| 241 d40/d90 | 242 d10/d95 | 243 Sub 44u | 244 Sand Control Method |
|---|---|---|---|
| < 3 | < 10 | < 2% | Well sorted sand with low fines content – SAS completions Premium, Wire Wrapped Screen or Pre-packed Screen |
| < 5 | < 10 | < 5% | Low to medium sorting range, with fines just out of range Premium Screen if d10 is larger that 200 micron |
| < 5 | < 20 | < 5% | Medium sorting and fines content Gravel Pack, Expandable Screen or HRWP |
| < 5 | < 20 | < 10% | Medium sorting with higher fines content. Gravel Pack or Frac Pack |
| > 5 | > 20 | > 10% | Poorly sorted sand with high fines content. Frac Pack |

FIG.2D

SAND SCREEN SELECTION

CROSS-REFERENCE TO RELATED APPLICATIONS

This application claims the benefit of U.S. Provisional Patent Application No. 63/271,516, entitled "SAND SCREEN SELECTION," filed Oct. 25, 2021, the disclosure of which is incorporated by reference herein in its entirety.

BACKGROUND

In the resource recovery industry boreholes are formed in a formation for the purpose of stimulating and or producing formation fluids. A tubular may be positioned in the wellbore to guide fluids to a surface of the formation. The tubular may include one or more openings that permit formation fluids to enter and flow toward the surface. In many cases, a screen will be positioned over the one or more openings in order to prevent or at least limit debris from passing into the tubular with the formation fluid.

SUMMARY

One or more embodiments described herein relate to sand screen selection.

In one embodiment, a method for sand screen selection is provided. The method includes performing a geomechanical analysis for a wellbore for each of a plurality of sand screens. The method further includes selecting a sand screen from the plurality of sand screens based at least in part on the geomechanical analysis. The method further includes deploying the selected sand screen in a tubular of the wellbore to filter particulate passing through an opening of the tubular In another exemplary embodiment, a resource exploration and recovery system includes a wellbore, a control system, and a tubular string. The control system performs a geomechanical analysis for the wellbore for each of a plurality of sand screens and selects a sand screen from the plurality of sand screens based at least in part on the geomechanical analysis. The tubular string extends into the wellbore. The tubular string supports the sand screen selected from the plurality of sand screens.

In yet another embodiment, a method for sand screen selection is provided. The method includes performing an initial geomechanical sanding risk assessment for a wellbore. The method further includes performing a particle size analysis for the wellbore. The method further includes performing a particle size distribution analysis for the wellbore. The method further includes performing a sand control selection criteria evaluation for the wellbore. The method further includes determining a geomechanical analysis to determine time to auto-pack. The method further includes performing a standalone sand screen types evaluation. The method further includes performing a sand retention test and screen erosion modeling. The method further includes selecting a sand screen from a plurality of sand screens based at least in part on the sand control selection criteria evaluation, the geomechanical analysis, the standalone sand screen types evaluation, and the sand retention test. The method further includes deploying the selected sand screen in a tubular of the wellbore to filter particulate passing through an opening of the tubular.

The above features and advantages, and other features and advantages, of the disclosure are readily apparent from the following detailed description when taken in connection with the accompanying drawings.

BRIEF DESCRIPTION OF THE DRAWINGS

The following descriptions should not be considered limiting in any way. With reference to the accompanying drawings, like elements are numbered alike:

FIG. 2D depicts a table of sand control selection criteria according to one or more embodiments described herein;

DETAILED DESCRIPTION

A detailed description of one or more embodiments of the disclosed apparatus and method are presented herein by way of exemplification and not limitation with reference to the figures.

One or more embodiments described herein relate to sand screen selection, which can be based on, for example, geomechanical analysis.

Figure 1:
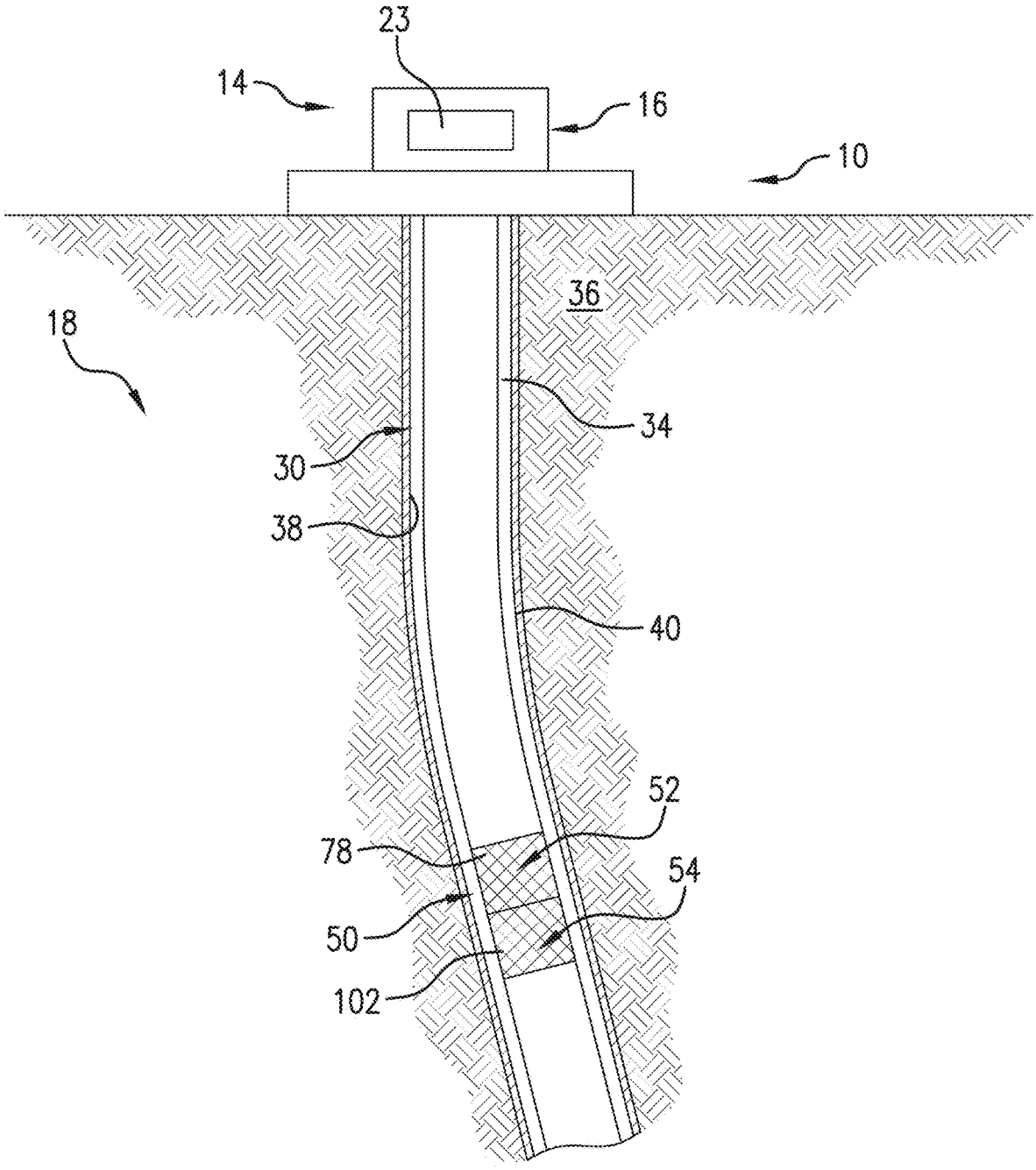
FIG. 1 is an example of a system for performing downhole operations including a screen, in accordance with an exemplary embodiment.

With reference to FIG. 1, a resource exploration and recovery system 10 is depicted according to one or more embodiments described herein. Resource exploration and recovery system 10 should be understood to include well drilling operations, completions, resource extraction and recovery, CO2 sequestration, and the like. Resource exploration and recovery system 10 may include a first system 14 which, in some environments, may take the form of a surface system 16 operatively and fluidically connected to a second system 18 which, in some environments, may take the form of a downhole system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a tubular string 30 that extends into a wellbore 34 formed in formation 36. Tubular string 30 may take the form of a plurality of interconnected tubulars, coil tubing, or the like. Wellbore 34 includes an annular wall 38 which may be defined by a casing tubular 40. Of course, annular wall 38 could be defined by a surface of formation 36.

According to one or more embodiments described herein, tubular string 30 supports a screen 50. The screen 50 can include one or more screen portions, shown as a first screen portion 52 and a second screen portion 54. In some case, a valve member can be arranged internally of the first and second screen portions 52 and 54.

According to one or more embodiments described herein, a first screen segment 78 is provided and may be formed separately from the first screen portion 52. The first screen segment 78 filters formation fluids passing into the first screen portion 52.

According to one or more embodiments described herein, a second screen segment 102 and may be formed separately from the second screen portion 54. The second screen segment 102 filters formation fluids passing into the second screen portion 54.

It should be appreciate that other arrangements of screens are possible, and that the screen 50 of FIG. 1 is merely one possible example.

One or more embodiments described herein provide for integration of sand retention tests, grain size data, and/or geomechanical sand volume quantification (e.g., geomechanical analysis) to advance sand screen selection and design. Integration of geomechanical sand volume estimation with particle size analysis data and sand retention test results provides for improved sand screen selection through the modeling of formation collapse, the likelihood of auto-packing, its timing considering production forecast and reservoir pressure over the entire well life, and the like. This integration improves traditional sand screen selection.

Conventional approaches for selecting sand screens are based on statistical interpretation of target formation particle size data (grain scale) with further qualification of selected screens through sand retention laboratory testing using formation particle sizes (or analogue). Conventional sand retention laboratory testing assesses sand screen performance in term of pressure drop, plugging resistance, and the characters of effluent (e.g., sand grains passing through the screen under a fixed laboratory flow condition). The selection of standalone screens, applicable for formations with very uniform and well-sorted grain size distribution, is based on the assumption that, as soon as the well is put under a production condition, the formation will collapse on the screen. The failed formation material will fill the annulus (and perforation tunnel) via bridging and natural packing (also called auto-pack), and thus protecting the screen from erosion and plugging. in some cases, the sizing of the screen's opening is generally based on the 10%-20% largest size of the formation grain size range. Hence 80-90% of the formation grains would not be filtered by the screen alone. With the formation collapse under the drawdown condition, it is expected that the grains larger than the screen's opening to fill the annulus and create an "auto-pack" around the screen limiting and eventually stopping passing of sand grains with diameters less than the screen opening while allowing the flow of hydrocarbon through the screen due to the expected high permeability of the auto-pack. However, this assumption is not true for poorly sorted formations as a less permeable auto-pack will lower the well production and could cause screen and well integrity issues. The conventional selection procedure for standalone screens (SAS) that uses the auto-pack presumption, which relies on an immediate formation collapse from the onset of production, regardless of well and formation pressures and whether sufficient volume of solids from failed formation material will be generated to fully pack the annulus over the entire screen length. In reality, or sometimes, such conditions may not eventuate, hence the selection of SAS could pose a well completion risk and preference can be switched to more advanced sand control options such as sand screens with multiple filtering screens with different openings and layering such as so called premium screens, pre-packed screens, or sand control systems with a sand screen combined with manually packing the annulus with pre-designed and sized gravel.

In addition to the issues with formation sorting level, conventional approaches for selecting sand screens fail to consider how long it will take to fill the annulus with the formation solids to avoid excessive solids production before auto-pack, the risks of plugging and erosion in the mean time, and other such considerations.

According to one or more embodiments described herein, techniques are provided for selecting standalone sand screen type by considering the timing of auto-pack. This can be accomplished, for example, via sand volume quantification using geomechanical sanding evaluation as a new and additional selection criteria in the sand screen selection procedure. In this process, geomechanical analysis can be used to estimate the expected volume (or mass) of sand (solids) to be produced over the life of the well pressure condition. The estimated expected volume of produced solids can be integrated with the grain size analysis and sand retention test results to define the likelihood of formation collapse and the volume of formation sands needed for a full pack of the annulus (for a range of borehole diameter and screen sizes) for both open and cased and perforated holes. As one example, geomechanical analysis (also referred to as geomechanical sanding evaluation) can define one or more of the following: the timing of sanding (e.g., onset of sanding), the location of sand producing zone(s) in wells, the severity of sanding (e.g., sand volume and rate over the well life), combined with hole stability assessment (e.g., the likelihood of formation collapse) during production, and/or the like. In particular, sand volume estimation and formation collapse assessment during production (e.g., for one or both open and cased/perforated holes) can be used to define one or more of the following: the likelihood of formation collapse, the timing of sanding and its progress with production in terms of sand volume generated, the sand volume for a full auto-pack (e.g., for given well and screen sizes), and the estimate of time span from the onset of sanding to creation of full auto-pack, or the like.

The integration of geomechanical analysis can further be used to qualify specific sand screen type(s) in addition to the conventional method based solely on grain size distribution and sand retention testing observations. Production profile and geomechanical characters that lead to immediate (or quick) formation collapse creating full auto-pack along the screen can lead to the qualification of simple sand screens such as wire-wrapped screens (WWS), whereas wells with no immediate formation collapse means that the time to auto-pack could be several months/years, hence the need for deploying more advanced sand screens such as premium screens or sand control systems. This additional selection criteria enhances the longevity of sand control. For example, any standalone screens with no immediate full auto-pack may suffer from plugging, erosion and excessive sand production despite the installation of downhole sand exclusion.

According to one or more embodiments described herein, a method is provided for well-life sand volume estimation for open hole and/or cased hole completion. In one or more examples, the method can be used for defining the timing of auto-pack as a qualifier for the selection of sand screen type.

One or more embodiments for scan screen selection described herein provide improvements over conventional sand screen selection, such as by considering formation failure behavior under drawdown conditions (e.g., during part or the entire production interval and well-life scale) through upscaling of laboratory sand retention test results to well scale considering near wellbore pressure and flow condition.

One or more embodiments described herein provide one or more advantages such one or more of the following: as increasing sand screen longevity and well productivity through improved sand screen selection; providing technical justification for advanced sand screen products, such as premium sand screens, and sand control systems over the simple and conventional single mesh sand screens; providing inputs and insights for root cause failure analysis (e.g., failed screens, excessive sanding chokes erosion, etc.) and thus improved decisions for remedial sand control options; proactive production management and well intervention forecasts and planning; cross-discipline solutions and well intervention services equipped with reservoir and well life insights; and the like.

One or more embodiments described herein utilize geomechanical analysis (e.g., sand volume estimation) and formation collapse during production (e.g., for one or both open and cased/perforated holes) to define the likelihood of formation collapse, timing of auto-pack, and/or the volume of solids for full pack. These determinations can be used to supplement the sand screen selection criteria with the well-life sand volume estimation (e.g., specific well and screen size and production plan) combined with particle size distribution data sand retention test results and erosion modeling to qualify and justify the selection of a specific sand screen (e.g., either standard single mesh screen, premium sand screen, and/or other advanced screen types, etc.).

Figure 2A:
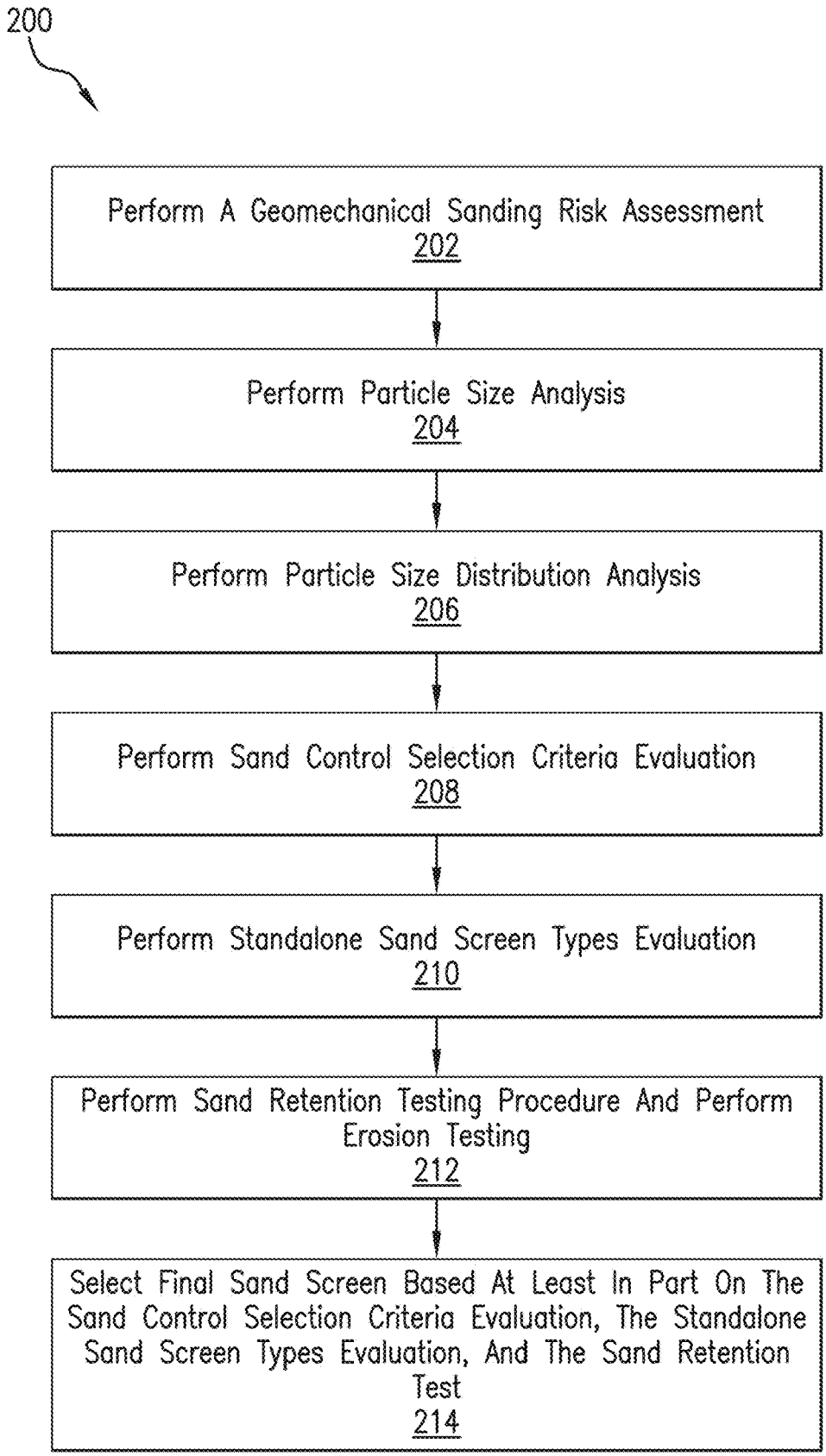
FIG. 2A depicts a method for selecting standalone screen type according to one or more embodiments described herein.

FIG. 2A depicts a method 200 for selecting standalone screen type according to one or more embodiments described herein. The method 200 can be performed by any suitable device and/or system, such as the control system 23 of FIG. 1, the processing system 600 of FIG. 6, and/or the like, including combinations and/or multiples thereof.

Figure 2B:
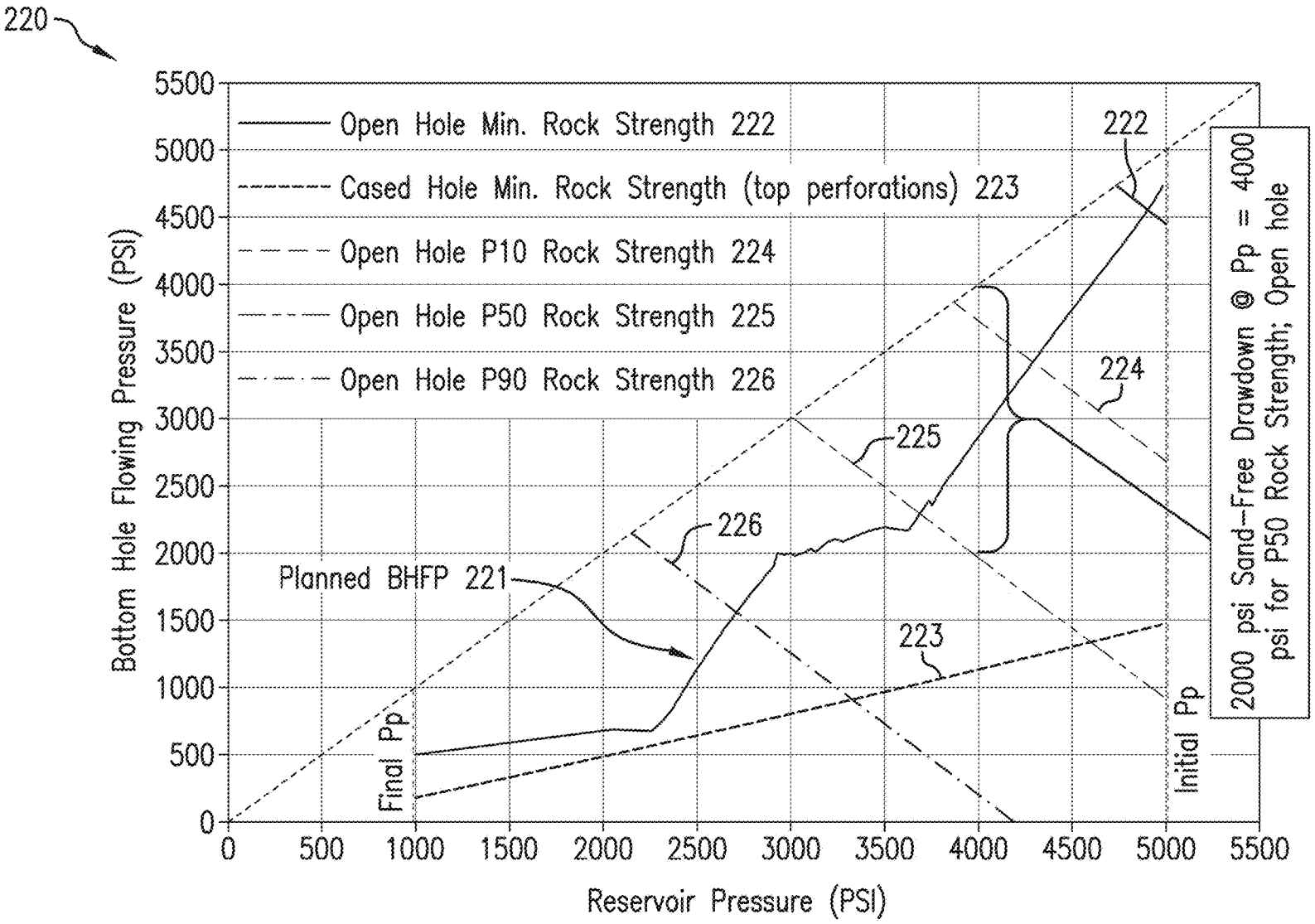
FIG. 2B depicts a graph of an example of geomechanical sanding risk assessment according to one or more embodiments described herein.

At block 202, a geomechanical sanding risk assessment is performed. The sanding risk assessment is performed using rock mechanical and formation geomechanical evaluations. According to one or more embodiments described herein, the timing, location, and/or severity of sand production can be modeled for the life of well and reservoir depletion. FIG. 2B depicts a graph 220 of an example of geomechanical sanding risk assessment according to one or more embodiments described herein. In this example, the sanding risk assessment is a sand-free operating envelope for a horizontal well; however, other sanding risks assessments are also possible. The graph 220 depicts a planned bottomhole flowing pressure (BHFP) 221, which is plotted as bottom hole flowing pressure (in pounds per square inch (PSI)) against reservoir pressure (also in PSI). The graph 220 further shows an open hole minimum rock strength 222, a cased hole minimum rock strength (for perforations oriented to the top of hole) 223, an open hole P10 rock strength 224, an open hole P50 rock strength 225, and an open hole P90 rock strength 226.

With continued reference to FIG. 2A, at block 204, a particle size analysis is performed. An example of a particle size analysis includes characterizing a reservoir grain size by sieve and laser particle analyses plus petrographical examination.

Figure 2C:
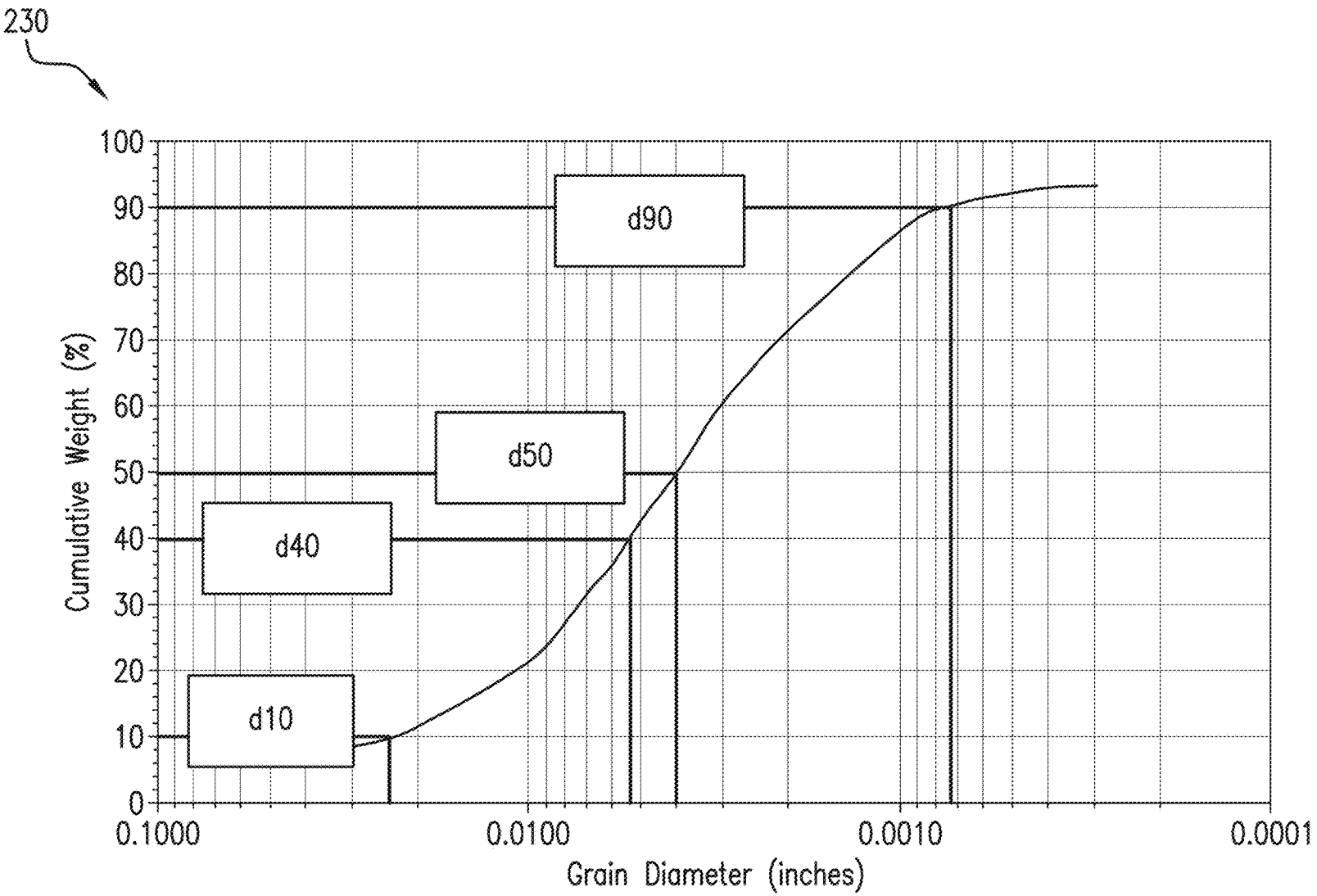
FIG. 2C depicts a graph of an example particle size distribution according to one or more embodiments described herein.

At block 206, a particle size distribution (PSD) analysis is performed. For example, from laboratory work on representative rock samples, a number of parameters can be defined to describe the PSD of the target formation. Examples of parameters include one or more of the following: uniformity coefficient (UC) (e.g., UC=d40/d90), sorting coefficient (SC) (e.g., SC=d10/d95), percentage of fine or fine content (e.g., %<45 micron), and/or the like, including combinations and/or multiples thereof. FIG. 2C depicts a graph 230 of an example particle size distribution according to one or more embodiments described herein. The graph 230 plots grain diameter (in inches) against cumulative weight (as a percentage). The graph 230 can be used to determine one or more of the uniformity coefficient, sorting coefficient, and/or percentage of fine or fine content.

At block 208, a sand control selection criteria evaluation is performed to determine which scan screen type will serve as a basis for sand control selection. Standalone screens have a tight selection window (see, e.g., box 245 of FIG. 2D) and may be suitable for fairly uninform (UC<5), well sorted (SC<10), and very low fine content (<5%) formations, for example.

At block 210, a standalone sand screen types evaluation is performed. For example, within the variety of the existing standalone screens, there are types that may be more suitable and/or could perform better than other(s) in a given target formation(s) (e.g., due to the homogeneity of the formation). Thus, at block 210, different types of scan screens can be evaluated, such as a slotted liner sand screen, a prepak sand screen, a wirewrap sand screen, a premium sand screen, expandable sand screens, and/or the like, including combinations and/or multiples thereof.

Figure 2E:
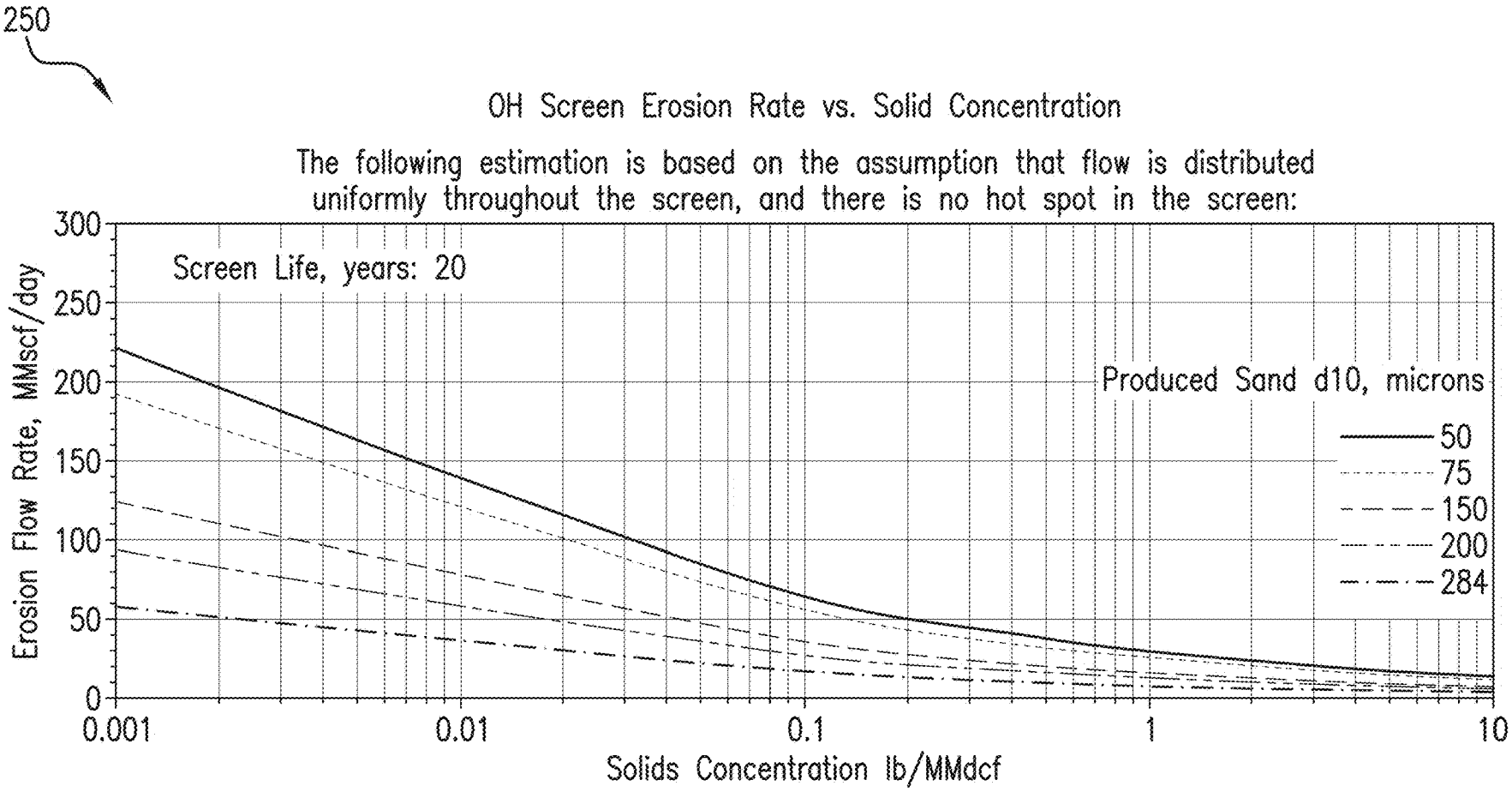
FIG. 2E depicts a graph of open hole screen erosion rate versus solids concentration according to one or more embodiments described herein.
Figure 2F:
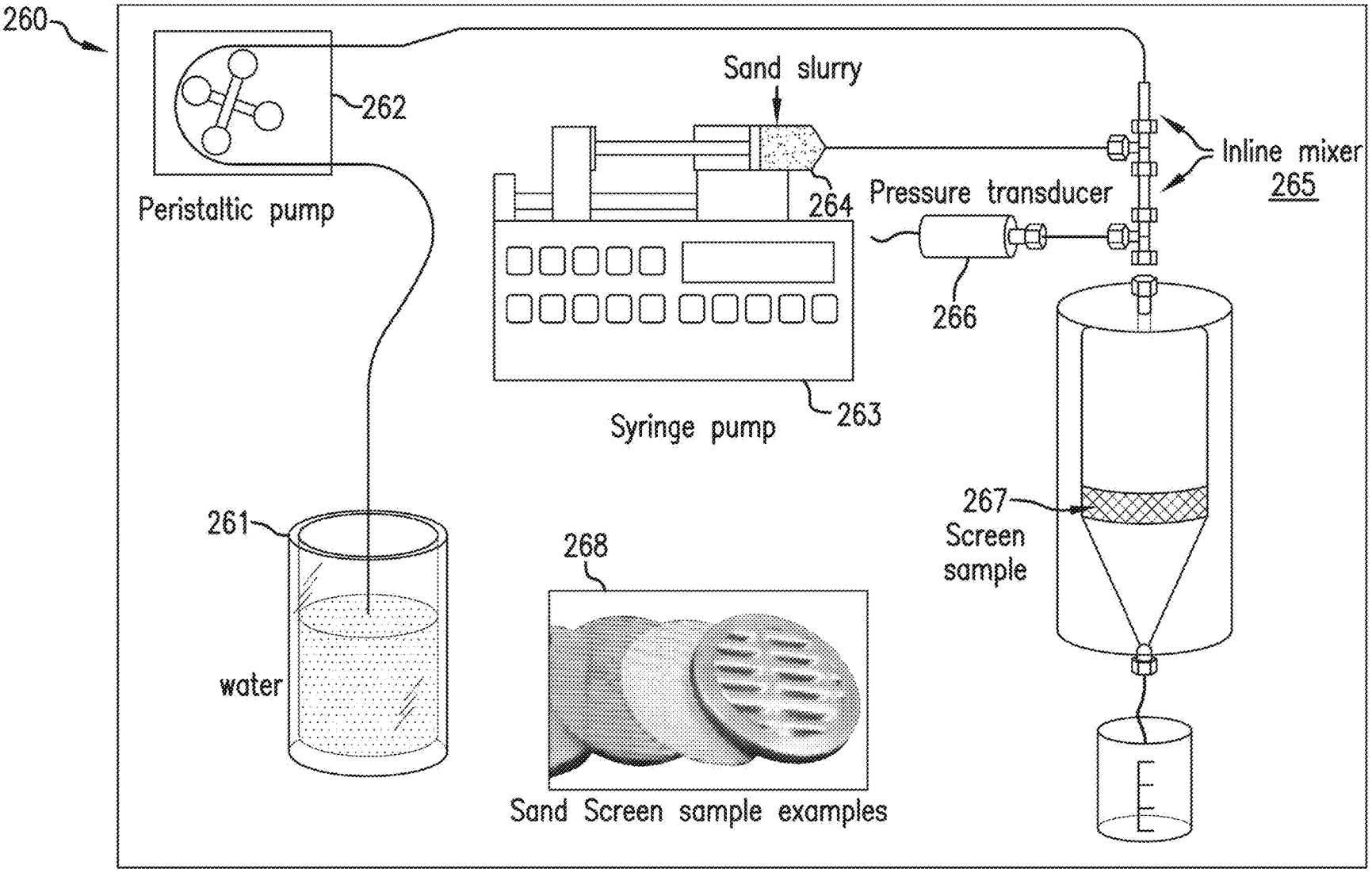
FIG. 2F depicts an example sand retention test set up according to one or more embodiments described herein.
Figure 2G:
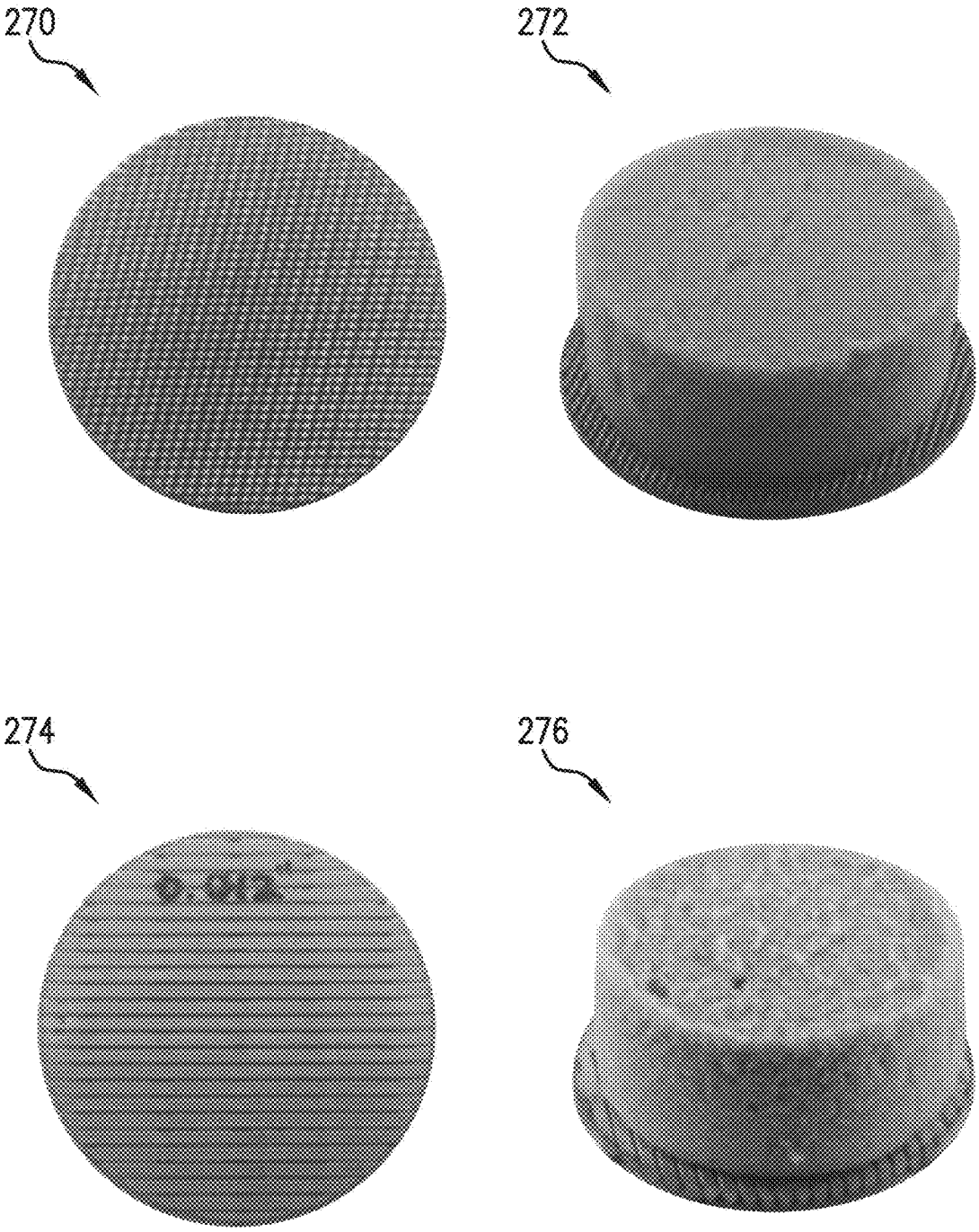
FIG. 2G depicts sand screen samples from the sand screen sample examples of FIG. 2F according to one or more embodiments described herein

At block 212, a sand retention testing procedure is performed. The sand retention testing procedure helps to define screen type and sizing for a final screen (i.e., a screen to be deployed in a tubular of a wellbore). The selected sand screen(s) (from block 210) is then qualified using sand retention testing with the selected formation planned shut down (PSD) to assess performance of the screen(s) (e.g., pressure drop), plugging, and the characteristics of effluent (e.g., sand grain size and rate). Sand retention testing is followed by performing erosion modeling, as shown in FIG. 2E. For example, in FIG. 2E, a graph 250 of open hole screen erosion rate versus solids concentration is shown according to one or more embodiments described herein. The solids concentration (e.g., sanding rate) is an input for erosion and productivity modeling. The graph 250 assumes that flow is distributed uniformly throughout the screen and that there are no hot spots in the screen section (i.e., auto-pack has occurred). FIG. 2F depicts an example sand retention test setup 260 according to one or more embodiments described herein. In this example, the setup 260 includes water 261, a peristaltic pump 262 to pump the water 261, a syringe pump 263 to pump a sand slurry 264, an inline mixer 265 to mix the water 261 and the sand slurry 264, a pressure transducer 266 to measure pressure, and a screen sample 267 selected from the sand screen sample examples 268. FIG. 2G depicts sand screen samples from the sand screen sample examples 268 of FIG. 2F according to one or more embodiments described herein. In particularly, FIG. 2G depicts a screen sample 270 of a 352 μm premium screen with corresponding post SRT sand pack 272 and a screen sample 274 of a 300 μm WWS screen with corresponding post SRT sand pack 276.

At block 214, a final sand screen is selected based at least in part on the sand control selection criteria evaluation, the standalone sand screen types evaluation, and/or the sand retention test. According to one or more embodiments described herein, this determination can be based at least in part on performance in a laboratory test.

The application of standalone screens has the premise of auto-pack which is also called natural pack. Auto-pack is the collapse of the formation on the screen during production. During auto-pack, solids generated from the formation failure will fill the annulus (and, in at least some cases, perf tunnels). Since the screen sizing is based on the d10 or thereabout of the formation grain size, for example, the larger grains of the failed formation create a bridging or filter, resembling a natural pack that protects the screen from erosion and plugging by smaller grains.

Additional processes also may be included, and it should be understood that the process depicted in FIG. 2A represents an illustration, and that other processes may be added or existing processes may be removed, modified, or rearranged without departing from the scope of the present disclosure.

Figure 3:
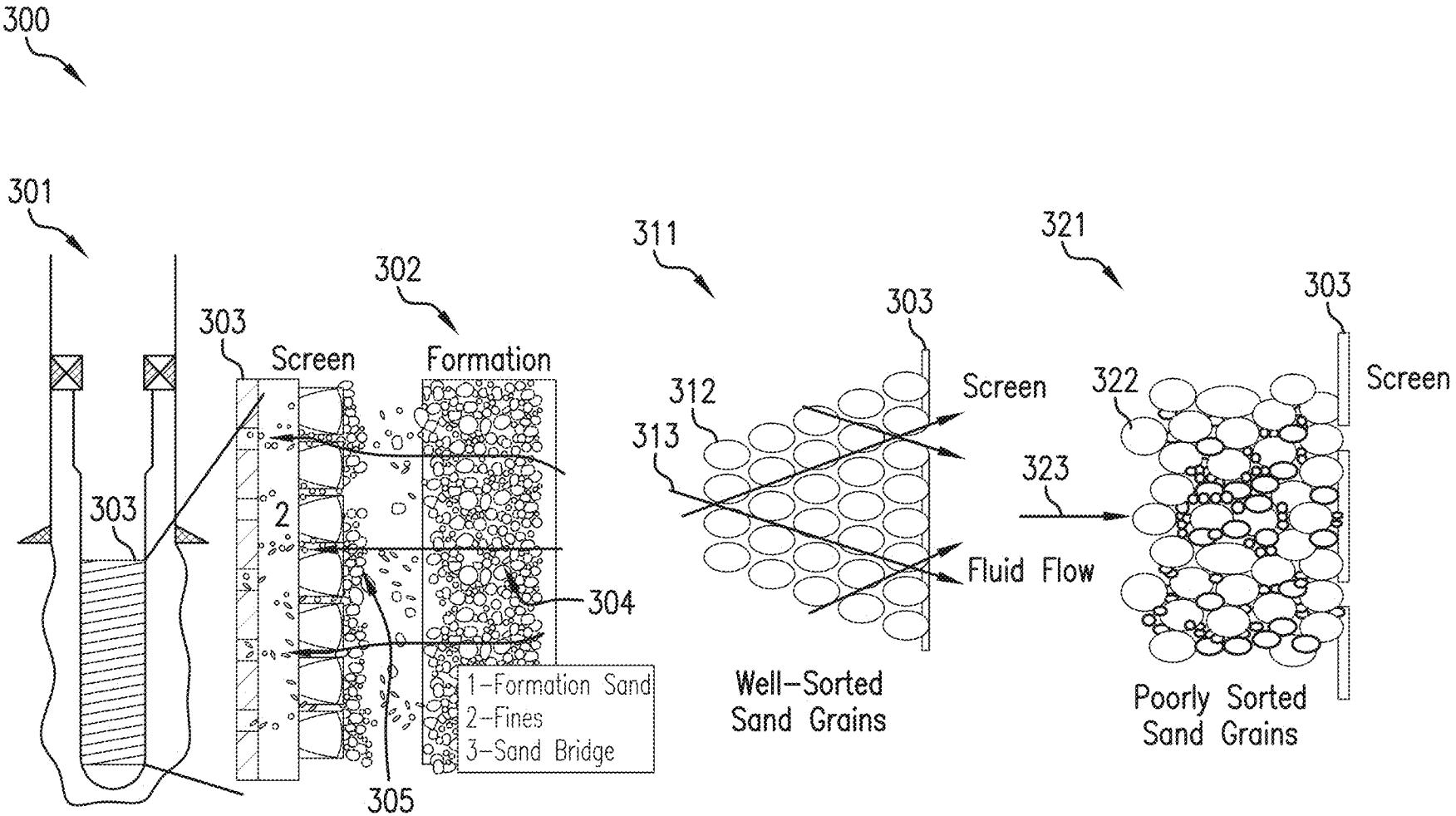
FIG. 3 depicts graphical representations an arrangement for standalone screen selection according to one or more embodiments described herein.

The approach shown in FIG. 2A is suitable for well sorted and very uniform sand grains where the auto-pack should have a good permeability. However, this may not always be the case. In poorly sorted formations, for example, a less permeable auto-pack may occur due to the presence of fines, silts, and small sand grains in the natural pack, which in turn can affect the well production and cause screen and well integrity issues. For example, FIG. 3 shows both scenarios (e.g., well-sorted sand grains and poorly sorted sand grains) as two different auto-pack assumptions 311, 321. Particularly, FIG. 3 depicts graphical representations an arrangement for standalone screen selection 300 according to one or more embodiments described herein. In this arrangement, a wellbore 301 extends into a formation 302 having a screen 303 disposed therein according to one or more embodiments described herein. The formation 302 includes gains of sand 304 (e.g., "formation sand") that form a sand bridge 305 at an outer surface of the screen 303. "Fines" 306, or smaller grains of sand, pass through the sand bridge 305 and openings of the screen 303 as shown for extraction.

As shown in FIG. 3, at least two different auto-pack assumptions 311, 321 are possible, for example, for standalone screen selection 300. The auto-pack assumption 311 shows well-sorted sand grains 312 through which fluid 313 can flow. The fluid 313 can then flow through openings in the screen 303. Conversely, the auto-pack assumption 321 shows poorly sorted (relative to the auto-pack assumption 311) sand grains 322, which prevents and/or inhibits the flow of fluid 323 as shown. Thus, the fluid 323 is prevented and/or inhibited from reaching the screen 303, and thus less fluid would flow through the screen 323 than the screen 303. This affects the amount of fluid that passes from the formation 302 through the screen 303 for extraction.

Additional considerations not addressed by conventional approaches to screen selection regarding the auto-pack assumption 311, 321 of FIG. 3 are as follows. First, how long it will take to fill the annulus with the formation solids. In other words, what is the time to auto-pack? This is a geomechanical question that depends, for example, on rock property, stresses, production profile, reservoir performance, etc. Secondly, for a delayed auto-pack, what will be the risks of screen plugging and erosion and excessive solids production before auto-pack? These parameters are not considered in conventional screen selection.

Pitfalls of the auto-pack assumptions of FIG. 3 can include one or more of the following: a rapid development of auto-pack, from the onset of production, or soon after, which in turn it means an immediate formation collapse, regardless of flow rates, pressure and stress condition and rock mechanical properties; and/or with the premise of the formation failure will produce sufficient solids volume to fully pack the annulus over the entire screen length. In reality sometimes, such assumptions/pre-requisites may not be realized, hence the selection of standalone screen could pose a well completion and integrity risk affecting the well productivity and economics. To address this concern, the novel method shown in FIG. 4 utilizes a geomechanical assessment for sand screen selection.

Figure 4:
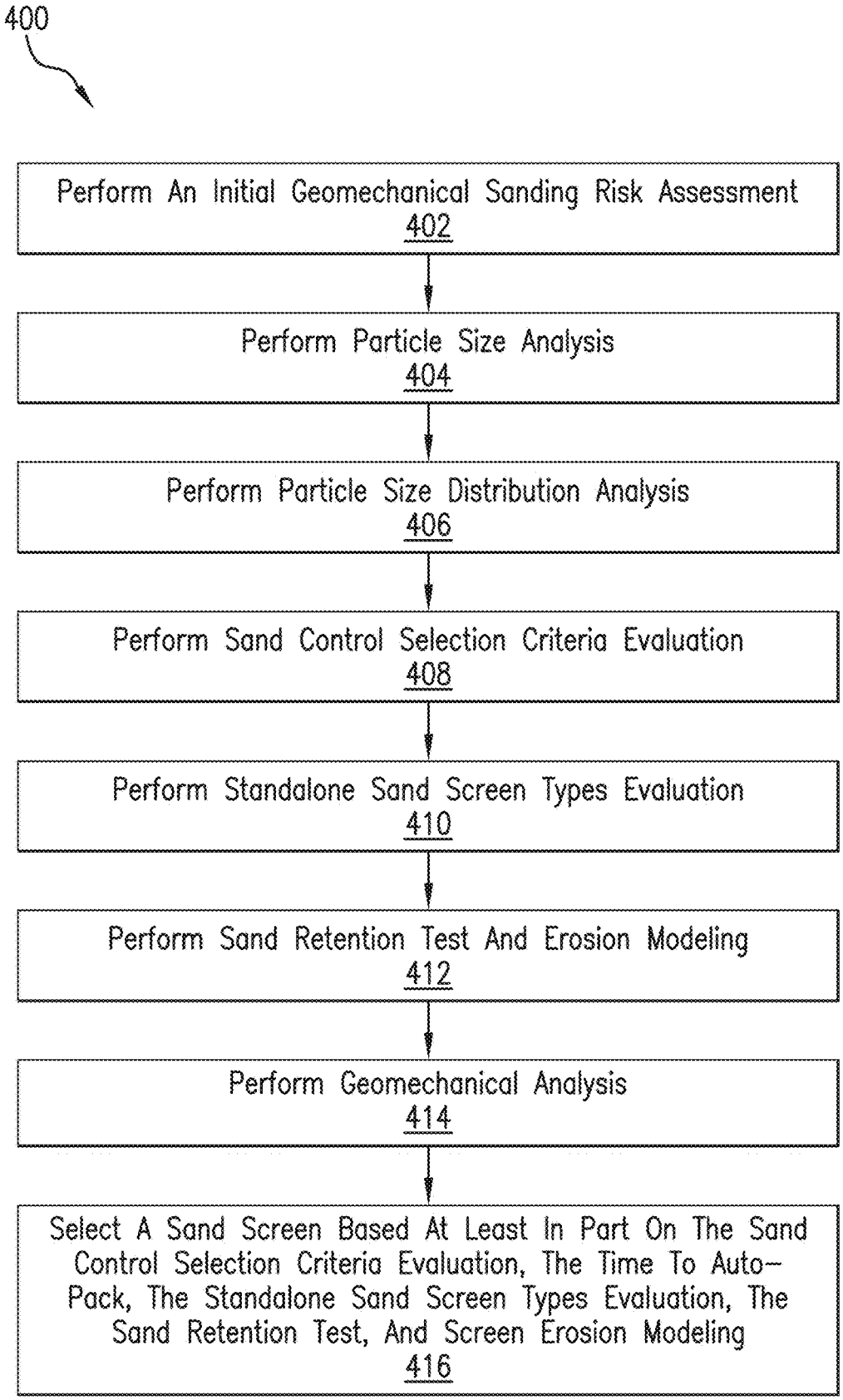
FIG. 4 depicts a flow diagram of a method for standalone screen type selection according to one or more embodiments described herein.

For example, FIG. 4 depicts a flow diagram of a method 400 for standalone screen type selection according to one or more embodiments described herein. The method 200 can be performed by any suitable device and/or system, such as the control system 23 of FIG. 1, the processing system 600 of FIG. 6, and/or the like, including combinations and/or multiples thereof.

In the example of FIG. 4, a geomechanical assessment is performed in terms of sand quantification and formation failure analysis for both open hole and cased and perforated completions. This can provide insights on the likelihood of formation collapse and timing of auto-pack (e.g., the volume of solids for the pack) by providing a well-life sand volume estimation (e.g., for specific well and screen size and given production plan). When these are combined with PSD, sand retention test results, and erosion modeling, qualification of particular SAS or SAS versus sand control systems can be improved and justified.

At block 402, an initial geomechanical sanding risk assessment is performed. The sanding risk assessment can be performed using rock mechanical and formation geomechanical evaluations. According to one or more embodiments described herein, the timing, location, and/or severity of sand production can be modeled for the life of well and reservoir depletion. As described herein, FIG. 2B depicts a graph 220 of an example sanding risk assessment according to one or more embodiments described herein. In this example, the sanding risk assessment is a sand-free operating envelope for a horizontal well; however, other sanding risks assessments are also possible.

With continued reference to FIG. 4, at block 404 a particle size analysis is performed. An example of a particle size analysis includes characterizing a reservoir grain size by sieve and laser particle analyses plus petrographical examination.

At block 406, a particle size distribution (PSD) analysis is performed as described herein. For example, FIG. 2C depicts a graph 230 of an example particle size distribution according to one or more embodiments described herein.

With continued reference to FIG. 4, at block 408 a sand control selection criteria evaluation is performed to determine which sand screen type will serve as a basis for sand control selection.

At block 410 a standalone sand screen types evaluation is performed. For example, within the variety of the existing standalone screens, there are types that may be more suitable and/or could perform better than other(s) in a given target formation(s) (e.g., due to the homogeneity of the formation). Thus, at block 410, different types of sand screens can be evaluated, such as a slotted liner sand screen, a prepak sand screen, a wirewrap sand screen, a premium sand screen, expandable sand screens, and/or the like, including combinations and/or multiples thereof. According to one or more embodiments described herein, standalone sand screen types are selected.

At block 412, a sand retention testing procedure is performed. The sand retention testing procedure helps to define screen type and sizing for a final screen selection (i.e., a screen to be deployed in a tubular of a wellbore). According to one or more embodiments, a screen erosion assessment is conducted.

At block 414, a further detailed geomechanical analysis is performed. The geomechanical analysis determines (e.g., estimates) a time to auto-pack for the well. The geomechanical analysis may determine one or more of the following: solids volume to fill the annulus (for open hole, cased and perforated completions, etc.); formation collapse modeling; solids volume estimation, which can be well and production specific; time to auto-pack (e.g., hole and screen size specific), and/or the like, including combinations and/or multiples thereof.

At block 416, a sand screen is selected. The selection at block 416 can be based at least in part on the sand control selection criteria evaluation, the time to auto-pack, the standalone sand screen types evaluation, and the sand retention test and/or the like, including combinations and/or multiples thereof. The selection can also be based on screen erosion modeling according to one or more embodiments described herein. As an example, the results of blocks 408, 410, 412, and/or 414 can be combined to perform a final screen selection at block 416. A final screen selection can include a number of screens that are ranked based on time to auto-pack plus the sand retention test results and erosion modeling. In some examples, the screen with the highest rank can be selected. According to one or more embodiments described herein, the ranking is based on a lowest time to auto-pack. According to one or more embodiments described herein, the ranking is based on a best sand retention test performance. According to one or more embodiments described herein, if auto-pack is a concern, the ranking is based on 1) choosing erosion and plug resistant screen (e.g., premium); or 2) modifying production plan to reduce time to auto-pack; or 3) switch to expandables/gravel pack (GP)/frac-packing (F&P) systems.

Additional processes also may be included, and it should be understood that the process depicted in FIG. 4 represents an illustration, and that other processes may be added or existing processes may be removed, modified, or rearranged without departing from the scope of the present disclosure.

Figure 5:
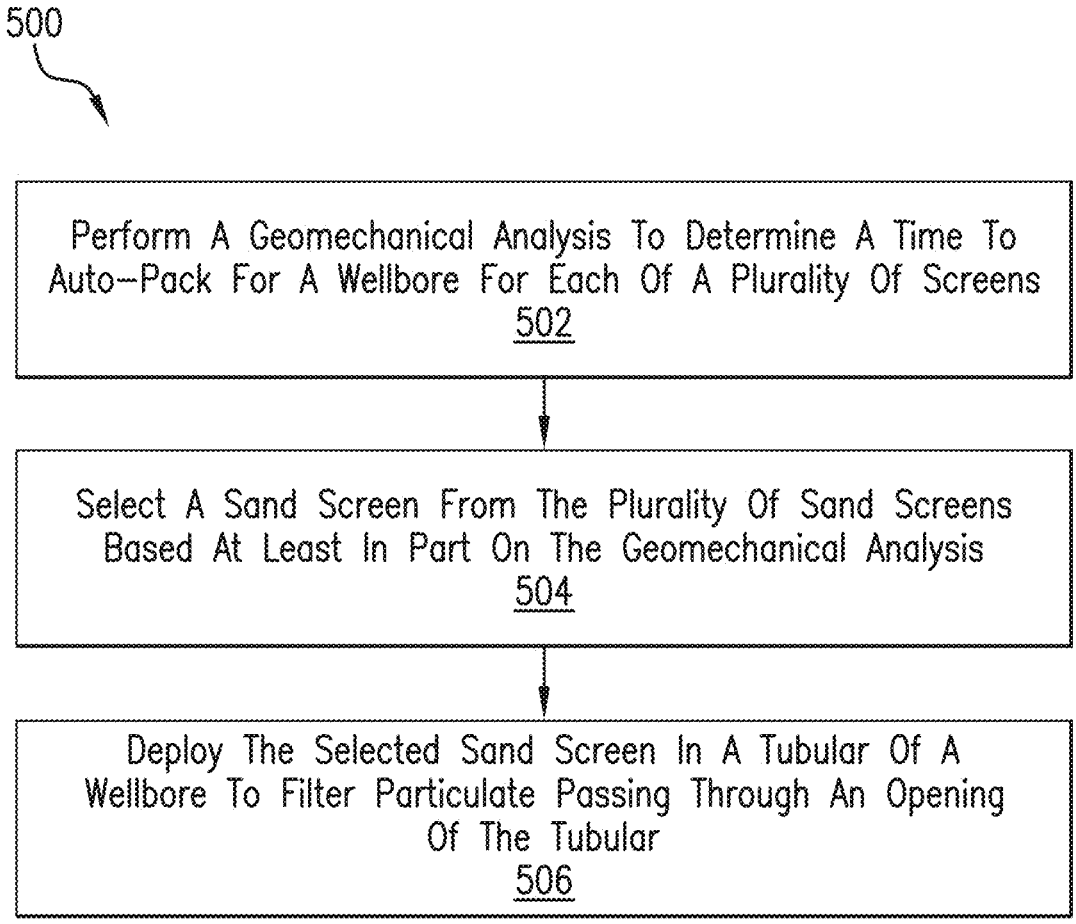
FIG. 5 depicts a flow diagram of a method for standalone screen type selection according to one or more embodiments described herein.

FIG. 5 depicts a flow diagram of a method 500 for standalone screen type selection according to one or more embodiments described herein. The method 200 can be performed by any suitable device and/or system, such as the control system 23 of FIG. 1, the processing system 600 of FIG. 6, and/or the like, including combinations and/or multiples thereof.

At block 502, a geomechanical analysis is performed. The geomechanical analysis can determine, for example, a time to auto-pack for a wellbore for each of a plurality of sand screens, a likelihood of formation collapse by modeling formation collapse, and/or the like, including combinations and/or multiples thereof as described herein.

At block 504, a sand screen is selected from the plurality of sand screens based at least in part on the geomechanical analysis. As described herein, the selection at block 504 can be based at least in part on the sand control selection criteria evaluation, the time to auto-pack, the standalone sand screen types evaluation using formation particle size distribution data, and the sand retention test and/or the like, and erosion modeling, including combinations and/or multiples thereof.

At block 506, the selected sand screen is deployed in a tubular (e.g., the tubular string 30) of a wellbore (e.g., the wellbore 34) to filter particulate passing through an opening of the tubular. Deploying the selected sand screen improves hydrocarbon exploration and recovery technologies by increasing production of hydrocarbons, for example. For example, because the selected sand screen is selected based at least in part on a geomechanical analysis, considerations such as time to auto-pack can be included in the selection of the deployed sand screen, resulting in an improved wellbore operation (e.g., improved production, avoid excessive solids production before auto-pack, reduce the risks of plugging and erosion before auto-pack, and/or the like, including combinations and/or multiples thereof).

Additional processes also may be included, and it should be understood that the process depicted in FIG. 5 represents an illustration, and that other processes may be added or existing processes may be removed, modified, or rearranged without departing from the scope of the present disclosure.

One or more embodiments of the invention is provided as follows:

Apart from the determination of critical pressure condition (or timing) for the onset of rock failure (initial failure) and the sanding interval, a complete sanding evaluation may also include the severity of sanding (e.g., the likely quantity of sand (solids) to be produced for individual wells under specific well and pressure conditions). Knowledge of the expected volume of produced solids provides an input for facility, well construction, and completion design, as well as sand management decisions including the choice between downhole (active) and passive sand control options with surface sand handling and disposal, well intervention considerations, and the frequency of downhole and surface facility clean ups, for example.

Included herewith is an example from a gas field in Western Australia where geomechanical sand volume estimation has played a role in defining sand management options for a number of existing and future planned wells. First, a field-calibrated geomechanical sanding prediction model was built using core, well logs and field sanding data from well tests in two recent appraisal/early development wells. The sanding model was further calibrated with historical sand-free production from two existing wells and a sand-free well test in the third appraisal well.

The field-life sanding assessment indicated considerable sanding risks within the first few years of production. The evaluation was then extended to a sand quantification. The sand volume estimation indicated an increase in sanding rate with further depletion and well intervention requirements for existing producers and active sand control for the newly drilled wells. The analysis also indicated negligible field life sanding risk for vertical and low-angle open hole wells.

Analytical sand volume estimation for an existing cased hole and a future deviated open hole well were used in conjunction with grain size analysis to upscale sand retention test (SRT) results to well life conditions and sand screen qualification. Grain size data showed low uniformity and sorting coefficients suggesting either WWS or premium standalone screen applications for the wells. SRT data on WWS and premium sand screen coupons with a range of screen meshes confirmed applicability of both screen types. The WWS coupons worked fine after the development of full sand packing whilst allowing a large amount of solids to pass through the screens before packing with an acceptable final screen permeability. The premium screen performed better from the onset with no sand pass while retaining 93% of the screen permeability.

With sanding expected from the onset of production and increasing with depletion, the sand volume quantification showed the time span for a complete auto-pack in a stand-alone screen application could range from ~4 years for a vertical cased hole to ~12 years for a deviated open hole. Hence an erosion- and plugging-resistant sand screen may perform better for existing cased and perforated wells and future deviated open holes. Finally, a premium sand screen was selected over the WWS based on sand retention testing results with further inputs from the geomechanical estimation of "time to auto-pack" and screen plugging concerns before auto-pack which were not evident from SRT or grain size data alone.

Figure 6:
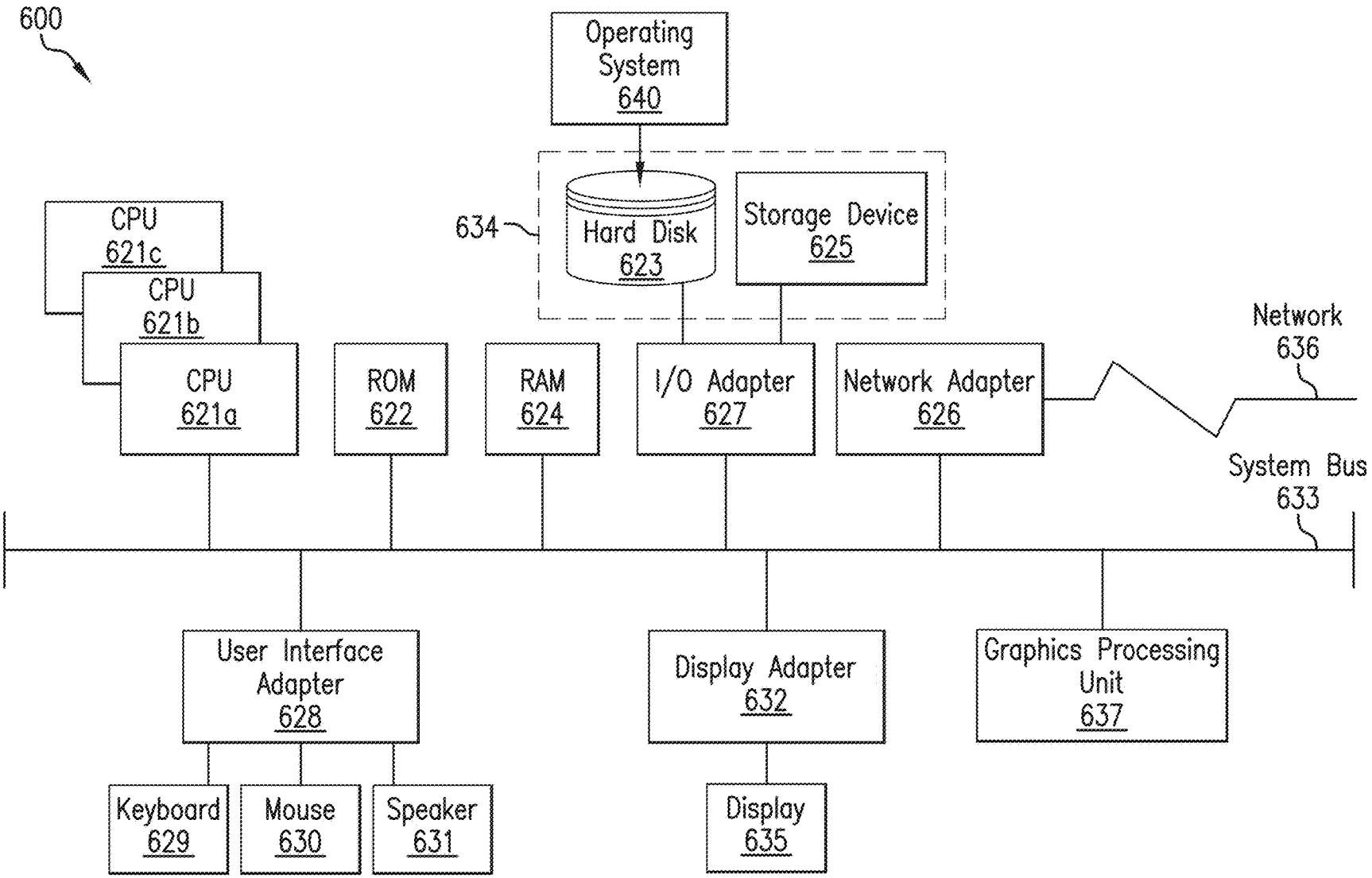
FIG. 6 depicts a block diagram of a processing system for implementing one or more embodiments described herein.

It is understood that one or more embodiments described herein is capable of being implemented in conjunction with any other type of computing environment now known or later developed. For example, FIG. 6 depicts a block diagram of a processing system 600 for implementing the techniques described herein. The processing system 600 is an example of the control system 23 of FIG. 1. In accordance with one or more embodiments described herein, the processing system 600 is an example of a cloud computing node. In examples, processing system 600 has one or more central processing units ("processors" or "processing resources" or "processing devices") 621*a*, 621*b*, 621*c*, etc. (collectively or generically referred to as processor(s) 621 and/or as processing device(s)). In aspects of the present disclosure, each processor 621 can include a reduced instruction set computer (RISC) microprocessor. Processors 621 are coupled to system memory (e.g., random access memory (RAM) 624) and various other components via a system bus 633. Read only memory (ROM) 622 is coupled to system bus 633 and may include a basic input/output system (BIOS), which controls certain basic functions of processing system 600.

Further depicted are an input/output (I/O) adapter 627 and a network adapter 626 coupled to system bus 633. I/O adapter 627 may be a small computer system interface (SCSI) adapter that communicates with a hard disk 623 and/or a storage device 625 or any other similar component. I/O adapter 627, hard disk 623, and storage device 625 are collectively referred to herein as mass storage 634. Operating system 640 for execution on processing system 600 may be stored in mass storage 634. The network adapter 626 interconnects system bus 633 with an outside network 636 enabling processing system 600 to communicate with other such systems.

A display 635 (e.g., a display monitor) is connected to system bus 633 by display adapter 632, which may include a graphics adapter to improve the performance of graphics intensive applications and a video controller. In one aspect of the present disclosure, adapters 626, 627, and/or 632 may be connected to one or more I/O busses that are connected to system bus 633 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 633 via user interface adapter 628 and display adapter 632. A keyboard 629, mouse 630, and speaker 631 may be interconnected to system bus 633 via user interface adapter 628, which may include, for example, a Super I/O chip integrating multiple device adapters into a single integrated circuit.

In some aspects of the present disclosure, processing system 600 includes a graphics processing unit 637. Graphics processing unit 637 is a specialized electronic circuit designed to manipulate and alter memory to accelerate the creation of images in a frame buffer intended for output to a display. In general, graphics processing unit 637 is very efficient at manipulating computer graphics and image processing, and has a highly parallel structure that makes it more effective than general-purpose CPUs for algorithms where processing of large blocks of data is done in parallel.

Thus, as configured herein, processing system 600 includes processing capability in the form of processors 621, storage capability including system memory (e.g., RAM 624), and mass storage 634, input means such as keyboard 629 and mouse 630, and output capability including speaker 631 and display 635. In some aspects of the present disclosure, a portion of system memory (e.g., RAM 624) and mass storage 634 collectively store the operating system 640 to coordinate the functions of the various components shown in processing system 600.

Set forth below are some embodiments of the foregoing disclosure:

Embodiment 1: A method for sand screen selection, the method including performing a geomechanical analysis for a wellbore for each of a plurality of sand screens; selecting a sand screen from the plurality of sand screens based at least in part on the geomechanical analysis; and deploying the selected sand screen in a tubular of the wellbore to filter particulate passing through an opening of the tubular.

Embodiment 2: A method according to any prior embodiment, wherein the geomechanical analysis determines a time to auto-pack for each of the plurality of sand screens.

Embodiment 3: A method according to any prior embodiment, wherein determining the time to auto-pack is based at least in part on a solids volume to fill an annulus of the wellbore.

Embodiment 4: A method according to any prior embodiment, wherein determining the time to auto-pack is based at least in part on formation collapse modeling.

Embodiment 5: A method according to any prior embodiment, wherein selecting the sand screen from the plurality of sand screens comprises selecting the sand screen from the plurality of sand screens having a lowest time to auto-pack.

Embodiment 6: A method according to any prior embodiment, wherein the geomechanical analysis comprises performing formation collapse modeling.

Embodiment 7: A method according to any prior embodiment, wherein the geomechanical analysis comprises performing determining a likelihood of formation collapse based at least in part on the formation collapse modeling.

Embodiment 8: A method according to any prior embodiment, further including performing a sand retention test for each of the plurality of sand screens.

Embodiment 9: A method according to any prior embodiment, wherein selecting the sand screen from the plurality of sand screens is further based at least in part on results of the sand retention test for each of the plurality of sand screens.

Embodiment 10: A method according to any prior embodiment, further including ranking each of the plurality of sand screens.

Embodiment 11: A method according to any prior embodiment, wherein the sand screen selected from the plurality of sand screens is the sand screen having a highest ranking.

Embodiment 12: A method according to any prior embodiment, wherein the ranking is based at least in part on a time to auto-pack.

Embodiment 13: A method according to any prior embodiment, further including performing a sand retention test, wherein the ranking is based at least in part on the sand retention test.

Embodiment 14: A method according to any prior embodiment, wherein the geomechanical analysis comprises determining a solids volume to fill an annulus of the wellbore, wherein the wellbore is an open hole or a cased and perforated wellbore.

Embodiment 15: A resource exploration and recovery system, the system including a wellbore; a control system to: perform a geomechanical analysis for the wellbore for each of a plurality of sand screens; and select a sand screen from the plurality of sand screens based at least in part on the geomechanical analysis; and a tubular string that extends into the wellbore, the tubular string supporting the sand screen selected from the plurality of sand screens.

Embodiment 16: A resource exploration and recovery system according to any prior embodiment, wherein the geomechanical analysis determines a time to auto-pack for each of the plurality of sand screens, and wherein selecting the sand screen from the plurality of sand screens is based at least in part on the time to auto-pack for each of the plurality of sand screens.

Embodiment 17: A resource exploration and recovery system according to any prior embodiment, wherein the geomechanical analysis comprises performing formation collapse modeling, and wherein the geomechanical analysis comprises performing determining a likelihood of formation collapse based at least in part on the formation collapse modeling.

Embodiment 18: A resource exploration and recovery system according to any prior embodiment, wherein the control system further ranks each of the plurality of sand screens, wherein the ranking is based at least in part on a time to auto-pack.

Embodiment 19: A method for sand screen selection, the method including performing an initial geomechanical sanding risk assessment for a wellbore; performing a particle size analysis for the wellbore; performing a particle size distribution analysis for the wellbore; performing a sand control selection criteria evaluation for the wellbore; determining a geomechanical analysis to determine time to auto-pack; performing a standalone sand screen types evaluation; performing a sand retention test and screen erosion modeling; selecting a sand screen from a plurality of sand screens based at least in part on the sand control selection criteria evaluation, the geomechanical analysis, the standalone sand screen types evaluation, and the sand retention test; and deploying the selected sand screen in a tubular of the wellbore to filter particulate passing through an opening of the tubular.

Embodiment 20: A method according to any prior embodiment, wherein the geomechanical analysis determines a time to auto-pack for each of the plurality of sand screens, and wherein selecting the sand screen from the plurality of sand screens is based at least in part on the time to auto-pack for each of the plurality of sand screens.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method for sand screen selection, the method comprising:

performing a geomechanical analysis for a wellbore for each of a plurality of sand screens, wherein the geomechanical analysis determines a time to auto-pack for each of the plurality of sand screens;

selecting a sand screen from the plurality of sand screens based at least in part on the geomechanical analysis; and deploying the selected sand screen in a tubular of the wellbore to filter particulate passing through an opening of the tubular.

2. The method of claim 1, wherein selecting the sand screen from the plurality of sand screens is based at least in part on the time to auto-pack for each of the plurality of sand screens.

3. The method of claim 2, wherein determining the time to auto-pack is based at least in part on a solids volume to fill an annulus of the wellbore.

4. The method of claim 2, wherein determining the time to auto-pack is based at least in part on formation collapse modeling.

5. The method of claim 1, wherein selecting the sand screen from the plurality of sand screens comprises selecting the sand screen from the plurality of sand screens having a lowest time to auto-pack.

6. The method of claim 1, wherein the geomechanical analysis comprises performing formation collapse modeling.

7. The method of claim 6, wherein the geomechanical analysis comprises determining a likelihood of formation collapse based at least in part on the formation collapse modeling.

8. The method of claim 1, further comprising performing a sand retention test for each of the plurality of sand screens.

9. The method of claim 8, wherein selecting the sand screen from the plurality of sand screens is further based at least in part on results of the sand retention test for each of the plurality of sand screens.

10. The method of claim 1, further comprising ranking each of the plurality of sand screens.

11. The method of claim 10, wherein the sand screen selected from the plurality of sand screens is the sand screen having a highest ranking.

12. The method of claim 11, wherein the ranking is based at least in part on the time to auto-pack for each of the plurality of sand screens.

13. The method of claim 11, further comprising performing a sand retention test, wherein the ranking is based at least in part on the sand retention test.

14. The method of claim 1, wherein the geomechanical analysis comprises determining a solids volume to fill an annulus of the wellbore, wherein the wellbore is an open hole or a cased and perforated wellbore.

15. A resource exploration and recovery system comprising:

a wellbore;

a control system to:

perform a geomechanical analysis for the wellbore for each of a plurality of sand screens, wherein the geomechanical analysis determines a time to auto-pack for each of the plurality of sand screens; and select a sand screen from the plurality of sand screens based at least in part on the geomechanical analysis; and a tubular string that extends into the wellbore, the tubular string supporting the sand screen selected from the plurality of sand screens.

16. The resource exploration and recovery system of claim 15, wherein selecting the sand screen from the plurality of sand screens is based at least in part on the time to auto-pack for each of the plurality of sand screens.

17. The resource exploration and recovery system of claim 15, wherein the geomechanical analysis comprises performing formation collapse modeling, and wherein the geomechanical analysis comprises determining a likelihood of formation collapse based at least in part on the formation collapse modeling.

18. The resource exploration and recovery system of claim 15, wherein the control system further ranks each of the plurality of sand screens, wherein the ranking is based at least in part on the time to auto-pack for each of the plurality of sand screens.

19. A method for sand screen selection, the method comprising:

performing an initial geomechanical sanding risk assessment for a wellbore;

performing a particle size analysis for the wellbore;

performing a particle size distribution analysis for the wellbore;

performing a sand control selection criteria evaluation for the wellbore;

determining a geomechanical analysis to determine time to auto-pack;

performing a standalone sand screen types evaluation;

performing a sand retention test and screen erosion modeling;

selecting a sand screen from a plurality of sand screens based at least in part on the sand control selection criteria evaluation, the geomechanical analysis, the standalone sand screen types evaluation, and the sand retention test; and deploying the selected sand screen in a tubular of the wellbore to filter particulate passing through an opening of the tubular.

20. The method of claim 19, wherein the geomechanical analysis determines a time to auto-pack for each of the plurality of sand screens, and wherein selecting the sand screen from the plurality of sand screens is based at least in part on the time to auto-pack for each of the plurality of sand screens.

* * * * *